United States Patent [19]

Böhme et al.

[11] Patent Number: 4,696,531

[45] Date of Patent: Sep. 29, 1987

[54] PLUG-IN TYPE CONTACT ARRANGEMENT

[75] Inventors: Helmut Böhme; Helmut Löbl; Steffen Grossmann, all of Dresden, German Democratic Rep.

[73] Assignee: VEB "Otto-Buchwitz" Starkstrom-Anlagebau Dresden, Dresden, German Democratic Rep.

[21] Appl. No.: 796,371

[22] Filed: Nov. 8, 1985

[30] Foreign Application Priority Data

Dec. 20, 1984 [DD] German Democratic Rep. ..... 2712595

[51] Int. Cl.[4] ..... H01R 13/11

[52] U.S. Cl. ..... 439/851

[58] Field of Search ..... 339/255 R, 255 P, 255 RT, 339/256 R, 256 S, 256 RT, 258 R, 258 P, 258 T

[56] References Cited

U.S. PATENT DOCUMENTS 1,740,640 12/1929 Austin ..... 339/256 S

FOREIGN PATENT DOCUMENTS 2902440 7/1979 Fed. Rep. of Germany ..... 339/256 RT

*Primary Examiner*—Joseph H. McGlynn

*Attorney, Agent, or Firm*—Gabriel P. Katona

[57] ABSTRACT

A plug-in type contact arrangement for high power electrical apparatus such as switch gear, wherein a fixed contact member carries a plurality of contact fingers having roller contacts mounted at one end thereof for reliably contacting a movable contact member when such movable contact member is forced into a contacting relationship with the fixed contact member and entering the cage-like receptacle formed by the circularly arranged contact fingers, and wherein the contact fingers are crimped at a predetermined point forming a first longitudinal portion and a second longitudinal portion arranged in different axial planes and connected by the crimping region, thereby transforming the contact pressure formed between the movable contact member and the roller contacts into a torsional load exerted on the contact fingers.

6 Claims, 3 Drawing Figures

PLUG-IN TYPE CONTACT ARRANGEMENT

FIELD AND BACKGROUND OF THE INVENTION

The present invention relates to a plug-in type contact arrangement for the coupling of electrical apparatus, such as apparatus and switch gear or their components used in high power applications and, which may have a circular, eliptical or angular cross-section as well as a rod-like shape for its first contact member, including also a second contact member having contact fingers formed thereon. In the second contact member the contact fingers are arranged according to the contour or shape of the first contact member and, wherein at their one end the contact fingers are secured in a component of the second contact member, while at their other end the contact fingers are provided with sliding contact means or roller type contact elements. Both contact members are displaceable relative to each other and in the axial direction. As a result of such displacement possibility, both contact members come into a contact relationship with each other when in an operational state.

Such plug-in type contacts are preferably employed in high power applications, where currents of more than 630 amperes are to be transmitted and where an interruption of the contacting assembly becomes necessary from time to time, such as, for checking the apparatus of the electrical gear served by the contact members. Such plug-in type contact arrangement becomes desirable also in an area where a visible separation of the circuit is necessary to indicate the operational state of the apparatus, such as, when the contact members are components within an electrical interrupter or part of a contact assembly between electrical power switches and switch gear, or for example, in an area where the electrical power switch gear should at least partially protrude from the apparatus.

Contact arrangements for a plug-in type electrical couplings of electrical apparatus, electrical gear and/or switching arrangements, which comprise a pair of axially displaceable contact members which come into a contact arrangement with each other by means of sliding or roller contacts, are known from German Patent Nos. 25 25 082 and 11 29 213.

Roller contacts enjoy an advantage over sliding contacts in that the force necessary for the relative movement of the contact members is reduced in them. Roller contacts are made up from a plurality of conducting members which are shaped in a rotational - symmetrical fashion and, which are rotatably journaled. They became known in different geometrical forms, such as in truncated cone shape (German Patent No. 11 67 946), as spherically shaped (German Patent No. 12 05 172), as spherical segment shaped (German Patent No. 10 03 323), as well as in disc shape arranged in pairs along a single axis (German Patent No. 10 40 653), and also as in the form of cylindrically shaped rollers (German Patent No. 12 16 968).

The contact force with which one of the contact members is pressed onto the other member, is brought about mostly by means of steel springs which are constructed as spiral or leaf springs, (see for example, German Patent Nos. 11 67 946 and 11 42 940). Such arrangements transmit, as far as requirements are concerned, considerable contact forces, therefore, they require a large number of roller contacts and posses undesirable radial dimensions which may unfavorably effect the spacing of the conductors and, thereby, the dimensions of the apparatus and of the switch gear.

In order to eliminate such disadvantages, plug-in tyep couplings became known, wherein the elements which are intended for carrying the electrical current are simultaneously used for producing the contact pressure (German Patent No. 11 45 254). Such elements are finger-shaped, serve as contact springs and they are manufactured from electrically good conducting material, such as, copper alloys and, are provided with rollers located in grooves at their ends facing the movable contact member, which rollers are in contacting relationship with grooves in the movable contact member. The contact springs under a bending load are capable of providing only an undefined contact force, since the bending itself is dependent to a large extent on the length of the transversely bending portions. In the event an offset develops between the axes of the movable contact member and of the fixed contact member due to manufacturing or assembly tolerances, then this will result in a situation where less than all the contact fingers will participate in bringing about the contacting. Such arrangement appears to be unsatisfactory also for the above-mentioned plug-in connection type applications for the reasons, that it can bring about a reliable contact state between the movable and fixed contact members only if there is a defined spacing between them.

SUMMARY OF THE INVENTION

It is, therefore, an object of the present invention, to provide a plug-in type coupling which possesses desirable radial dimensions and, which is capable of transmitting large currents and, at the same time, is capable of reliably meeting the various assembly and operating requirements.

It is another object of the present invention to provide a plug-in type coupling of the above type which is suitable for the transmission of large currents and, which under operating conditions is capable of providing sufficiently large and uniformly distributed contact pressure irrespective whether there is a radial offset present between the contact members which are to be coupled.

It is still another object of the present invention to provide the plug-in type coupling of the above type, which in addition to the above, is capable of compensating axial tolerances between the contact members which are to be coupled.

The foregoing and other objects of the present invention will become apparent as the following description proceeds and features of novelty which characterize the invention will be pointed out in particularity in the claims affixed to and forming a part of this specification.

BRIEF DESCRIPTION OF THE DRAWINGS

The invention will become more readily apparent from the following description of a preferred embodiment thereof shown, by way of example, in the accompanying drawings, in which.

DESCRIPTION OF THE PREFERRED EMBODIMENT

Figure 1:
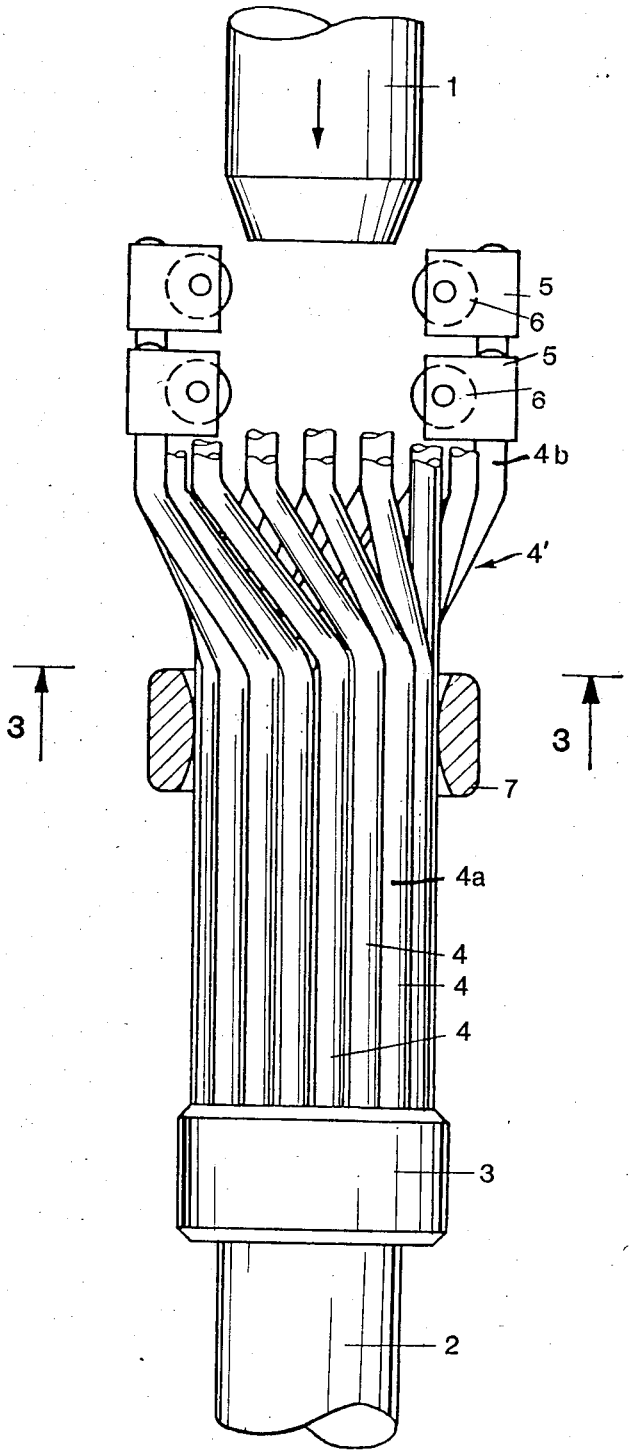
FIG. 1 is a schematic illustration of a plug-in type coupling according to the present invention illustrating the contact members as having a circular cross-section and, roller contacts on the contact fingers of the fixed contact member, with some parts broken away or partly in section for purposes of improved illustration.
Figure 3:
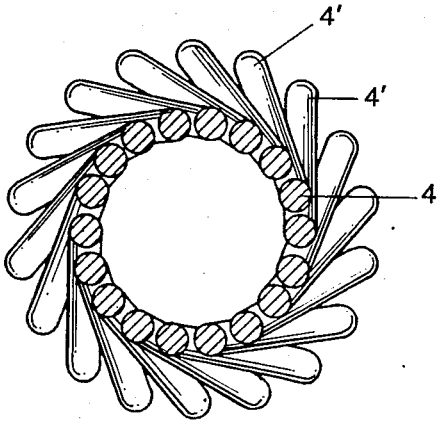
FIG. 3 is a sectional illustration of the fixed contact member according to FIG. 1 along a section line taken along the plane 3—3.

With reference to FIG. 1 illustrating a first movable contact member 1 and a second fixed contact member 2 both having a circular cross-section, it is noted that contact member 2 fixedly supports in a flange 3 thereof a plurality of contact fingers 4 which are of circular cross-section and which are crimped or twisted at region 4' in an offset fashion starting at the plane B—B as can be seen also more clearly in FIG. 3. As a result of the crimping each finger 4 will have a first straight section 4*a* in one axial plane, a crimped section 4' and a second straight section 4*b* lying in an axial plane different from the first section. The flange 3 and the contact fingers 4 are fixedly secured to contact member 2 so that a perfect current conduction exists therebetween. At the end of the contact fingers 4 roller guides 5 are secured which receive the contact rollers 6 in a journaled fashion therein. The movable or first contact member 1 is dimensioned such that whenever it enters the circular cage-like space formed by the plurality of contact fingers 4, that is, when it is brought into operational condition with contact member 2, the contact rollers 6 become forced radially outward. The fact that the contact fingers 4 are crimped or twisted as illustrated, they will undergo in the region between the section line B—B and their retention point in the flange 3 a torsional loading. The spring-like or resilient action resulting from the above mutual effect of the contact fingers 4 and of the movable contact member 1, will come about not by a bending force but by a torsional force as can be understood with reference to the illustrated embodiment.

In the region of the twisting or crimping 4' is, in addition, an annular shaped tensioning ring 7 is provided. Such ring 7 has its main function in that in the event there is an axial offset between the contact members 1 and 2, then it will force all of the contact fingers 4 with their associated rollers 6 into contact with the contact member 1.

Figure 2:
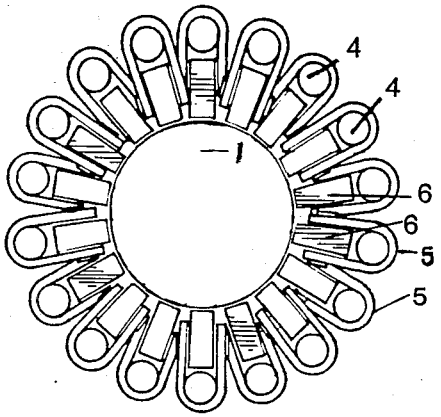
FIG. 2 is a top view of the fixed contact member with its contact fingers according to FIG. 1 and contact member 1 and 2 into operational condition.

In FIGS. 2 and 3 similar parts are identified by the same reference characters as in FIG. 1.

For purposes of exemplary illustration, the contact fingers 4 are shown with a circular cross-section and, the region of the crimping or twisting 4' in FIG. 3 can be viewed from a different perspective. In this region 4' the contact fingers 4 act as levers and transform the force exerted by the contact member 1 onto the contact rollers 6 into a torsional load arising within the contact fingers 4 underneath the lower part of the crimping region 4'.

It is within the scope of the present invention to shape the contact fingers 4 in the region of the roller guides 5, that is, above the lower crimping point of region 4', with a different geometric shape, such as, for example to have a quadratic cross-section. Also in the region of the torsional loading it is possible to have a cross-section other than circular for the contact fingers, for example, to provide an eliptical cross-section, or others.

We wish it to be understood that we do not desire to be limited to the exact details of contstruction shown and described, for obvious modifications will occur to a person skilled in the art.

Having thus described the invention, what we claim as new and desire to be secured by Letters Patent, is a follows:

1. An electrical plug-in type contact arrangement comprising a first movable contact member, a second fixed contact member, a plurality of contact fingers, means for mounting said plurality of contact fingers on said second contact member, each of said contact fingers comprising at a free end portions thereof a contact element, each of said contact fingers being crimped or twisted to form a first portion of said contact finger in one axial plane and to form a second portion of said contact finger in a different axial plane offset with respect to the first axial plane, thereby to transform a pressure exerted by said first contact member when moved into contacting position towards said second contact member into a torsional loading arising within said contact fingers, means for surrounding said contact fingers adjacent the region of the crimping said contact fingers having free end portions each having a contact element adapted to exert pressure on the movable contact.

2. A plug-in type contact arrangement as claimed in claim 1, wherein said mounting means for said plurality of contact fingers is a flange means fixedly receiving one end of said contact fingers in a conducting relationship with said second contact member.

3. An electrical plug-in type contact arrangement comprising a first movable contact member, a second fixed contact member, a plurality of contact fingers, means for mounting said plurality of contact fingers on said second contact member, each of said contact fingers comprising at a free end portions thereof a contact element, each of said contact fingers being crimped or twisted to form a first portion of said contact finger in one axial plane and to form a second portion of said contact finger in a different axial plane offset with respect to the first axial plane, thereby to transform a pressure exerted by said first contact member when moved into contacting position towards said second contact member into a torsional loading arising within said contact fingers, means for surrounding said contact fingers adjacent the region of crimping, wherein said first contact member is in the form of a rod having a circular cross-section, and wherein said contact contact fingers are arranged in a circular fashion for forming a cage-like configuration and for surrounding said first contact member when in contacting position with said second contact member, and wherein said contact elements comprise guide means and contact roller means mounted in said guide means for journaling therein and rolling along the surface of said first contact member when entering said cage-like formation of said plurality of contact fingers.

4. The plug-in type contact arrangement as claimed in claim 3, wherein each of said contact fingers is circular in cross-section and comprises a first axial longitudinal portion having one end of each of said contact fingers entering said mounting means, and a second axial longitudinal portion lying in a different axial plane then said first axial longitudinal portion and a crimped region connecting said first and second axial longitudinal portions.

5. An electrical plug-in type contact arrangement comprising a first movable contact member, a second fixed contact member, a plurality of contact fingers, means for mounting said plurality of contact fingers on said second contact member, each of said contact fingers comprising at a free end portions thereof a contact element, each of said contact fingers being crimped or twisted to form a first portion of said contact finger in one axial plane and to form a second portion of said contact finger in a different axial plane offset with respect to the first axial plane, thereby to transform a pressure exerted by said first contact member when moved into contacting position towards said second contact member into a torsional loading arising within said contact fingers, means for surrounding said contact fingers adjacent the region of the crimping, wherein said plurality of contact fingers are arranged in a circular fashion and forming a cage-like receptacle for said first contact member, said contact elements coming into a tangential contacting relationship with said first movable contact member when said first movable contact member enters a circular cage-like receptacle formed by said plurality of said contact elements, said first contact member forcing said contact fingers radially and outwardly, said crimping region transforming said radial pressure unto said contact rollers into a torsional force arising within said contact fingers.

6. An electrical plug-in type contact arrangement comprising a first movable contact member, a second fixed contact member, a plurality of contact fingers, means for mounting said plurality of contact fingers on said second contact member, each of said contact fingers comprising at a free end portions thereof a contact element, each of said contact fingers being crimped or twisted to form a first portion of said contact finger in one axial plane and to form a second portion of said contact finger in a different axial plane offset with respect to the first axial plane, thereby to transform a pressure exerted by said first contact member when moved into contacting position towards said second contact member into a torsional loading arising within said contact fingers, means for surrounding said contact fingers adjacent the region of the crimping, wherein said contact fingers are arranged in a circular fashion for forming a cage-like formation, and wherein said means for surrounding said contact fingers is an annular member placed on said plurality of contact fingers below said crimping region for limiting the radial extent of flexing of said contact elements, thereby forcing each of said contact elements against said movable contact member along the axial entry thereof into said cage-like formation while traveling towards said second contact member.

* * * * *